United States Patent [19]

Bryan et al.

[11] Patent Number: 4,695,535

[45] Date of Patent: Sep. 22, 1987

[54] SILVER HALIDE PHOTOSENSITIVE MATERIAL

[75] Inventors: Philip S. Bryan; Arthur H. Herz, both of Rochester, N.Y.

[73] Assignee: Eastman Kodak Company, Rochester, N.Y.

[21] Appl. No.: 947,455

[22] Filed: Dec. 29, 1986

[51] Int. Cl.[4] ..... G03C 1/08

[52] U.S. Cl. ..... 430/569; 430/251; 430/455; 430/611; 430/603

[58] Field of Search ..... 430/251, 455, 569, 600, 430/603, 611

[56] References Cited

U.S. PATENT DOCUMENTS

| | | | |
|---|---|---|---|
| 3,271,157 | 9/1966 | McBride | 430/603 |
| 3,507,657 | 4/1970 | Kitze | 430/600 |
| 3,531,289 | 9/1970 | Wood | 430/603 |
| 3,574,628 | 4/1971 | Jones | 430/567 |

FOREIGN PATENT DOCUMENTS

| | | | |
|---|---|---|---|
| 85420 | 7/1978 | Japan | 430/603 |

*Primary Examiner*—Richard L. Schilling
*Assistant Examiner*—Patrick Doody
*Attorney, Agent, or Firm*—Thomas F. Kirchoff

[57] ABSTRACT

A photographic silver halide emulsion is described which comprises an acyclic thioether compound which is capable of enhancing silver halide crystal growth without causing fog formation. A process for preparation of the emulsion is also described.

13 Claims, No Drawings

SILVER HALIDE PHOTOSENSITIVE MATERIAL

The present invention relates to a photosensitive silver halide emulsion and to a process for preparation thereof. In particular this invention relates to a silver halide emulsion comprising one or more thioether substituted compounds.

Many thioether compounds are described as having utility in the photographic art. For example, they are recognized as having utility as silver halide ripening agents and as growth modifiers for silver halide grains.

Japanese Patent Publication No. 85420/1978 (priority of Jan. 6, 1977) describes thioether compounds which are stated to be capable of enhancing the sensitivity and growth rate of photographic silver halide grains without causing undesirable increases in fog formation during storage prior to use. The thioether compounds described in this Publication can comprise terminal carboxy groups on alkyl thioether chains bonded to a benzene nucleus. However, as is shown below by comparative data, compounds described in this Publication fail to provide sufficient silver halide growth modification as is desired in the photographic art.

U.S. Pat. No. 3,574,628 describes organic macrocyclic thioether compounds as useful ripening agents in the manufacture of silver halide grains. A preferred thioether compound is 1,10-dithia-4,7,13,16-tetraoxacyloctadecane. However, as is demonstrated below by comparative data, this compound causes undesired fog formation upon storage so that its otherwise beneficial effects cannot be fully realized in silver halide manufacture.

Accordingly, the objects of the present invention are to provide a photographic silver halide emulsion, and a process for preparation thereof, which emulsion comprises a compound which improves silver halide crystal growth rates and which imparts superior ripening properties without causing fog formation upon extended storage thereof.

The present invention provides a photographic silver halide emulsion comprising an acyclic thioether compound having the structural formula:

$$HO_2C(C_2H_4S)_2(CH_2)_n(CHR^1)_n(CHR^2)_n(SC_2H_4)_2CO_2H$$

wherein $R^1$ is hydrogen, hydroxy or —COOH;

$R^2$ is hydrogen or —$(CH_2)_2COOH$; and each n is independently 1 or 2, or alkali metal or ammonium salts thereof.

Specific examples of thioether compounds falling within the description of this invention include:

1. 9-hydroxy-4,7,11,14-tetrathiaheptadecandioic acid $$HO_2C(C_2H_4S)_2CH_2CHOHCH_2(SC_2H_4)_2CO_2H$$

2. 9,10-dihydroxy-4,7,12,15-tetrathiaoctadecandioic acid $$HO_2C(C_2H_4S)_2CH_2(CHOH)_2CH_2(SC_2H_4)_2CO_2H$$

3. 10-(3-carboxypropyl)-4,7,11,14-tetrathiaheptadecandioic acid $$HO_2C(C_2H_4S)_2(CH_2)_2CH(CH_2CH_2COOH)(SC_2H_4)_2CO_2H$$

4. 10,11-dicarboxy-4,7,14,17-tetrathiaeicosandioic acid $$HO_2C(C_2H_4S)_2(CH_2)_2(CHCOOH)_2(CH_2)_2(SC_2H_4)_2CO_2H$$

5. 10-carboxy-4,7,13,16-tetrathianonadecandioic acid $$HO_2C(C_2H_4S)_2(CH_2)_2CH(COOH)(CH_2)_2(SC_2H_4)_2CO_2H$$

The thioether compounds described herein can be synthesized by the reaction of a mercapto alkanoic acid, e.g. 6-mercapto-4-thiahexanoic acid, with an epoxy containing compound, such as epichlorohydrin or 1,3-butadiene diepoxide. The syntheses of Compounds 1 and 2 are illustrated below.

SYNTHESIS I

Preparation of Compound 1

To a one liter three necked flask equipped with a mechanical stirrer, reflux condenser with nitrogen inlet and an addition funnel was added 16.63 g (0.1 mol) of 6-mercapto-4-thiahexanoic acid (MW 166.26) and 400 ml of 0.5 molar sodium methoxide in methanol (0.2 mol). To this solution, under a positive pressure of nitrogen, was added dropwise at room temperature, a solution of 4.63 g (0.05 mol) of epichlorohdrin in 15 ml methanol. The addition was completed in about 10 minutes. The reaction mixture was heated at reflux with rapid stirring overnight, after which time about 300 ml of methanol was removed by distillation. After cooling to room temperature, 250 ml water was added to dissolve the solids. 17 ml 12M HCl in 250 ml water was then added slowly to the stirred solution. A precipitate was collected using a coarse sintered glass funnel after washing thoroughly with water. The solid was recrystallized from about 100 ml acetonitrile at about 0° C. collecting 13.1 g product. This product was further purified by dissolving in 200 ml boiling acetonitrile, treating with decolorizing carbon to clarify, diluting the reheated filtrate with 200 ml chloroform, and cooling to room temperature. The recrystallized product was collected and washed with 1:1 (v/v) acetonitrile:chloroform. Recrystallization from this solvent mixture was repeated, obtaining 10 grams of product (51% yield). m.p. 124–29.

SYNTHESIS 2

Preparation of Compound 2

To a one liter three necked flash equipped with a mechanical stirrer, reflux condenser with a nitrogen inlet and an addition funnel was added 24.94 g (0.15 mol) of 6-mercapto-4-thiahexanoic acid (MW 166.26) and 600 ml of 0.5 molar sodium methoxide in methanol (0.3 mol). To this solution was added dropwise a solution of 5.80 ml (0.075) mol) of 1,3-butadiene diepoxide (MW 86.09) (Aldrich Chemical Co., Milwaukee, Wisc.) in 25 ml anhydrous methanol. The addition was completed in about 15 minutes. The temperature increased from 22° C. to 30° C.

The reaction was heated at reflux with rapid stirring for two hours, after which about 450 ml of methanol were removed by distillation. The residue was diluted with 250 ml water followed by a solution of 26 ml concentrated HCl in 250 ml water. The solid which formed was collected and washed with water. Drying yielded 26 g white solid. The material was recrystallized twice at room temperature from about 700 ml acetonitrile to yield 21 g recrystallized product, m.p. 125°–129° C. The product had NMR, infrared, mass spectrum, and combustion analyses consistent with the proposed structure. The field desorption mass spec. indicated the proper molecular ion as well as the presence of some mono sodium salt of the product.

The tetrathiaether dicarboxylic acid compounds described herein can be employed as silver halide growth accelerators in the form of the acids per se or as their alkali metal or ammonium salts.

This invention also provides a process for the preparation of a silver halide emulsion which comprises adding from about 0.001 to about 10 g of a thioether compound, as described above, to said emulsion during preparation thereof or prior to coating the emulsion on a support.

In the present invention the described thioether compounds may be added to the silver halide emulsion at various stages durin manufacture. They may be added singly or in combination with other ripening agents, including other thioether compounds or silver complexes. For example, the compounds may be added during formation of silver halide grains, during the physical or chemical ripening stage. or in a separate step before coating. The silver halide grains can be formed according to processes generally well known in the art, with a double jet type process being preferred.

The double jet process comprises adding a silver nitrate aqueous solution and an aqueous solution of one or more halides (e.g., an alkali metal halide such as potassium bromide) simultaneously to a stirred solution of silver halide-protecting colloid (e.g., gelatin or gelatin derivative) through two separate jets. A thioether compound as described herein is preferably added to the protective colloid solution before initiation of silver halide formation.

Conditions for forming silver halide grains such as pH, pAg, temperature, etc., are not particularly limited when employed using compounds described herein. The pH is generally about 1 to 9, preferably about 2 to 6, and pAg is generally about 5 to 11, preferably about 7.0 to 10.0. Silver halide grains may be formed at temperatures between about 30° to about 90° C., with about 35° C. to about 80° C. being preferred.

An organic thioether compound as described herein is preferably added during precipitation of silver halide grains and/or during physical ripening in an amount of from about 0.001 to 10 g, preferably about 0.01 to 1 g, per mol of silver halide.

When a thioether compound of the type disclosed herein remains in a silver halide emulsion following preparation thereof, a reduction in fog formation upon extended storage is obtained. An effective concentration to retard such fog formation is from about $10^{-6}$ to about $10^{-2}$ mol of the compound per mol of silver halide.

Gelatin is preferred as the binder or protective colloid for the photographic emulsion of the present invention. However, other hydrophilic colloids are also suitable. For example, proteins such as gelatin derivatives, graft polymers of gelatin and other polymers, albumin, casein, cellulose derivatives such as hydroxyethyl cellulose, carboxymethyl cellulose, cellulose sulfate, sugar derivatives such as sodium alginate, starch derivatives and various synthetic hydrophilic homopolymers or copolymers such as polyvinyl alcohol, poly-N-vinylpyrrolidone, apolyacrylic acid, polymethacrylic acid, polyacrylamide, polyvinylimidazole, polyvinyl pyrazole can be used.

Acid-processed gelatin can be used as well as lime-processed gelatin. Further, gelatin hydrolyzates, and enzyme-hydrolyzed products of gelatin are also usable.

Surface active agents may be incorporated in a photographic emulsion layer or in another hydrophilic colloid layer as a coating aid to prevent build-up of static charge, to improve lubrication properties, to improve emulsion dispersion, to prevent adhesion, and to improve such photographic characteristics as acceleration of development, increase in contrast, or sensitization.

A photographic emulsion of the present invention can be applied to many different silver halide photographic light-sensitive materials due to its high photographic sensitivity, contrast, and fog reduction. For example, it can be used in high speed black-and-white negative films, in X-ray films and in multilayer color negative films.

A photographic emulsion of the present invention may contain antifogging agents or emulsion stabilizing agents, such as for example azaindenes, thionamides, azoles and the like.

The photographic emulsion of the present invention may be spectrally sensitized with dyes. Dyes which can be used include cyanine dyes, merocyanine dyes, composite cyanine dyes, composite merocyanine dyes, and hemioxonol dyes. Particularly useful dyes are those belonging to the merocyanine class. These dyes contain as a basic heterocyclic ring nucleus any nucleus ordinarily used in cyanine dyes.

The photographic emulsion of the present invention may contain color image-forming couplers, i.e., compounds capable of reacting with an oxidation product of an aromatic amine (usually a primary amine) to form a dye. Non-diffusing couplers containing a ballast group are desirable. Either 4-equivalent and 2-equivalent couplers are usable. In addition, colored couplers showing the effect of color correction, or couplers releasing a development inhibitor upon development (so-called DIR couplers) may be used.

A photographic emulsion of the present invention is coated on a support conventionally used for photographic light-sensitive materials such as a flexible support (e.g., plastic film, paper, etc.) or a rigid support (e.g., glass, etc.) according to a dip-coating method, roller coating method, curtain coating method or extrusion coating method.

Emulsions of the present invention can be applied to a multilayer multicolor photographic material comprising a support having provided thereon at least two layers having different spectral sensitivities. Multilayer multicolor photographic materials usually comprise a support having provided thereon at least one red-sensitive emulsion layer, at least one green-sensitive emulsion layer, and at least one blue-sensitive emulsion layer. The order of these layers can optionally be selected as occasion demands. Usually, a cyan-forming coupler is associated with the red-sensitive emulsion layer, a magenta-forming coupler is associated with the green-sensitive emulsion layer, and a yellow-forming coupler is associated with the blue-sensitive emulsion layer. In some cases, however, different layer arrangements may be employed.

The photosensitive emulsions obtained by the present invention can be processed according to known methods. A developer to be used for the black-and-white processing can contain conventional developing agents such as dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines or ascorbic acids.

As color-developing agents, there can be used primary aromatic amine developing agents such as phenylenediamines (e.g., 4-amino-N,N-diethylaniline, 3-methyl-4-amino-N,N-ethylaniline, 4-amino-N-ethyl-N-hydroxy-ethylaniline, 3-methyl-4-amino-N-ethyl-N-hydroxyethylaniline, 3-methyl-4-amino-N-ethyl-N-methanesulfonamidoethylaniline and 4-amino-3-methyl-N-ethyl-N-methoxyethylaniline. In addition, the developing agents described in L. F. A. Mason, Photographic Processing Chemistry (Focal Press, 1966), pp. 226–229, as well as those described in U.S. Pat. Nos. 2,193,015 and 2,592,364 may be used.

The present invention is described in further detail by the following non-limiting examples.

EXAMPLE I

The ripening activity of compounds of this invention compared with prior art compounds were determined from Rayleigh light scatter measurements of dispersed silver halides (L. Oppenheimer, T. H. James and A. H. Herz in "Practice Growth in Suspensions", A. L. Smithm, Editor, Academic Press, London, 1973, pp. 159–178).

Tests for silver halide growth rates were carried out with about 0.1 mM AgBr suspended in 0.1% gelatin (isoionic point 4.9) containing 28 mM $KNO_3$ at pH 6, in 30 vol. % methanol, at pBr 3 and 25° C. Thioether compounds as identified in the following table were added at the indicated concentrations. Turbidity was determined as a function of time and a linear plot (slope rate) thus obtained was taken as a measure of AgBr growth (or ripening) rate. Results are recorded in Table I.

TABLE I

| Thioether Compound (concentration) | AgBr Growth Rate |
|---|---|
| None (Control) | 1.0[1] |
| Dithiasuberic acid (3.0 mM)[2] | 2.8 |
| Compound 2 (0.06 mM) (Invention) | 4.5 |

[1]Reference against which other results are compared.
[2]Compound No. 7 in Japanese Patent Publication No. 85420/1978, having the formula $(-CH_2SCH_2COOH)_2$.

The effectiveness of Compound 2 of this invention in accelerating silver halide growth is clearly apparent from the above results. Even at a 50-fold increase in concentration, the dithiaether compound of the prior art falls far short of the results achieved with this invention.

EXAMPLE 2

Growth rate tests similar to those described in Example 1 were run at pH 3 using Compound 1 of this invention as described above. Results are recorded in Table II.

TABLE II

| Compound (Concentration) | AgBr Growth Rate |
|---|---|
| none (Control) | 1.0[1] |
| Compound 1 (0.05 mM) (Invention) | 14.0 |

[1]Reference against which the compound of the invention is compared.

As can be seen Compound 1 is a highly active ripening agent for silver halide.

EXAMPLE 3

When thioether Compounds 1 and 2, as described herein, are incorporated in chemically sensitized high speed silver halide emulsions they cause less fog as compared with known thioether ripening agents. This is demonstrated below.

The compounds identified in Table III were added, at 40° C., to sulfur and gold sensitized negative AgBrI gelatin emulsions containing about 0.001M KBr, at about pH 6. The emulsions were coated and processed in a hydroquinone/monomethyl-p-aminophenol sulfate type developer, such as those commercially available under the tradenames Kodak Developer DK-50 and D-19. Accelerated aging tests were carried out by storing coatings for 1 week at 49° C./50% relative humidity (RH). Results are shown below.

TABLE III

| Thioether Compound (Concentration) | Fog | |
|---|---|---|
| | Fresh | After Storage |
| none (Control) | 0.09 | 0.66 |
| Compound A* (1.5 mmoles) | 0.10 | 1.65 |
| Compound 1 (1.5 mmoles) | 0.08 | 0.61 |
| Compound 2 (1.5 mmoles) | 0.09 | 0.50 |

*Compound A is a macrocyclic 18 crown thioether having the formula $S(CH_2CH_2OCH_2CH_2OCH_2CH_2)_2S$, and is described in U.S. Pat. No. 3,574,628.

Table III demonstrates that retained amounts of the prior art ripening agent (Compound A) cause storage fog in a chemically surface-sensitized silver halide emulsion but that fog formation is not caused by the thioether compounds described in this invention.

It has been noted that the described tetrathiaether compounds form predominantly 1:1 complexes with silver ions and that such complexes are more stable with respect to dissociation than are known dithiaether dicarboxylic acid analogs, such as dithiasuberic acid. The dithiaether analogs combine stepwise with silver ions in 1:1 and 2:1 ratios.

While the above examples illustrate use of this invention with respect to silver bromide and silver bromiodide in excess bromide ion, the invention is also applicable to other silver halide compositions including AgClI and AgClBr, as well as silver chloride dispersions containing excess chloride ion and silver iodide dispersions containing excess iodide ions.

The thioether compounds described herein are advantageously used to form silver complexes that do not yield sulfide ions which cause adverse sensitometric changes. These thioether compounds are active silver halide solvents which are capable of dissolving silver halide in aqueous dispersions, for example in silver salt diffusion transfer systems.

This invention has been described in detail with particular reference to preferred embodiments thereof, but it will be understood that variations and modifications can be effected within the spirit and scope of the invention.

What is claimed is:

1. A silver halide photographic emulsion comprising an acyclic thioether compound having the structural formula:

$$HO_2C(C_2H_4S)_2(CH_2)_n(CHR^1)_n(CHR^2)_n(SC_2H_4)_2CO_2H$$

wherein $R^1$ is hydrogen, hydroxy or —COOH;

$R^2$ is hydrogen or $—(CH_2)_2COOH$; and each n is independently 1 or 2, or an alkali metal or ammonium salt thereof.

2. The photographic emulsion of claim 1 wherein the compound is present in an amount of from about 0.001 to about 10 g thereof per mol of silver halide.

3. The photographic emulsion of claim 1 wherein the compound is present in an amount of from about 0.01 to about 1 g thereof per mol of silver halide.

4. The photographic emulsion of claim 1 wherein the compound is present in an amount of from about $10^{-6}$ to about $0.5\times10^{-2}$ mol thereof per mol of silver halide.

5. The photographic emulsion of claim 1 wherein the thioether compound has the structural formula:

$$HO_2C(C_2H_4S)_2CH_2CHOHCH_2(SC_2H_4)_2CO_2H.$$

6. The photographic emulsion of claim 1 wherein the thioether compound has the structural formula:

$$HO_2C(C_2H_4S)_2CH_2(CHOH)_2CH_2(SC_2H_4)_2CO_2H.$$

7. The photographic emulsion of claim 1 wherein the thioether compound has the structural formula:

$$HO_2C(C_2H_4S)_2(CH_2)_2(CHCOOH)_2(CH_2)_2(SC_2H_4)_2CO_2H.$$

8. In a process for the preparation of a silver halide emulsion, the improvement which comprises adding, during preparation of said emulsion or prior to coating thereof on a support, from about 0.001 to about 10 g per mol of silver halide of a compound having the structural formula:

$$HO_2C(C_2H_4S)_2(CH_2)_n(CHR^1)_n(CHR^2)_n(SC_2H_4)_2CO_2H$$

wherein $R^1$ is hydrogen, hydroxy or —COOH;

$R^2$ is hydrogen or $—(CH_2)_2COOH$; and each n is independently 1 or 2, or an alkali metal or ammonium salt thereof.

9. The process of claim 8 wherein said compound is present in an amount of from about 0.01 to about 1 g thereof per mol of silver halide.

10. The process of claim 8 wherein said compound has the structural formula:

$$HO_2C(C_2H_4S)_2CH_2CHOHCH_2(SC_2H_4)_2CO_2H.$$

11. The process of claim 8 wherein said compound has the structural formula:

$$HO_2C(C_2H_4S)_2CH_2(CHOH)_2CH_2(SC_2H_4)_2CO_2H.$$

12. The process of claim 8 wherein said compound has the strcutural formula:

$$HO_2C(C_2H_4S)_2(CH_2)_2(CHCOOH)_2(CH_2)_2(SC_2H_4)_2CO_2H.$$

13. A silver halide emulsion prepared by the process of claims 9, 10, 11 or 12.

* * * * *